United States Patent [19]

Smith

[11] 4,260,206

[45] Apr. 7, 1981

[54] CABINET

[76] Inventor: Ronald W. Smith, 2300 Lazy Hollow #343-D, Houston, Tex. 77063

[21] Appl. No.: 53,071

[22] Filed: Jun. 28, 1979

[51] Int. Cl.[3] ..... A47B 77/00

[52] U.S. Cl. ..... 312/100; 312/140.1

[58] Field of Search ..... 312/100, 204, 212, 250, 312/137, 140.1, 234 R

[56] References Cited

U.S. PATENT DOCUMENTS

| | | | |
|---|---|---|---|
| 747,741 | 12/1903 | Marsh | 312/100 |
| 1,619,735 | 3/1927 | Johnson | 312/600 |
| 1,666,240 | 4/1928 | Hubert | 312/204 |
| 3,437,057 | 4/1969 | Wulff | 312/140.1 |
| 3,984,162 | 10/1976 | Zozeavo | 312/100 |

*Primary Examiner*—Casmir A. Nunberg

*Attorney, Agent, or Firm*—Robert W. B. Dickerson

[57] ABSTRACT

An article of furniture including a recessed portion for accomodating a removable planter as well as a storage area or areas for receiving a plurality of diverse items.

3 Claims, 6 Drawing Figures

CABINET

BACKGROUND OF THE INVENTION

There is a need, in the general furnishings industry, to develop products which may, on slight modification, present a substantially different appearance. There is a further need for attractive means for storing equipment commonly used in connection with outdoor cooking. The former problem is largely related to the economics generated on using interchangeable parts so as to satisfy the asthetic or whimsical desires of a house or apartment resident, without requiring the purchase of totally new pieces of furniture. The second problem area stems from the social tendency, especially during the past two decades, to entertain and/or prepare family food outdoors, such as on bar-b-que type cookers. Considering the relatively small amount of space oftentimes available to store equipment, such cooking equipment normally contributes to the clutter. The structure of this invention is intended to be operative in both problem areas, to wit, present an item of furniture (1) capable of substantial visual modification, and (2) adapted to store outdoor cooking equipment.

SUMMARY OF THE INVENTION

A cabinet member, which may have one or more general storage areas, also includes at least one concave area into which a removable planter may be positioned. The storage area or areas are adapted to receive the acoutrements of outdoor cookery.

DESCRIPTION OF A PREFERRED EMBODIMENT

Figure 1:
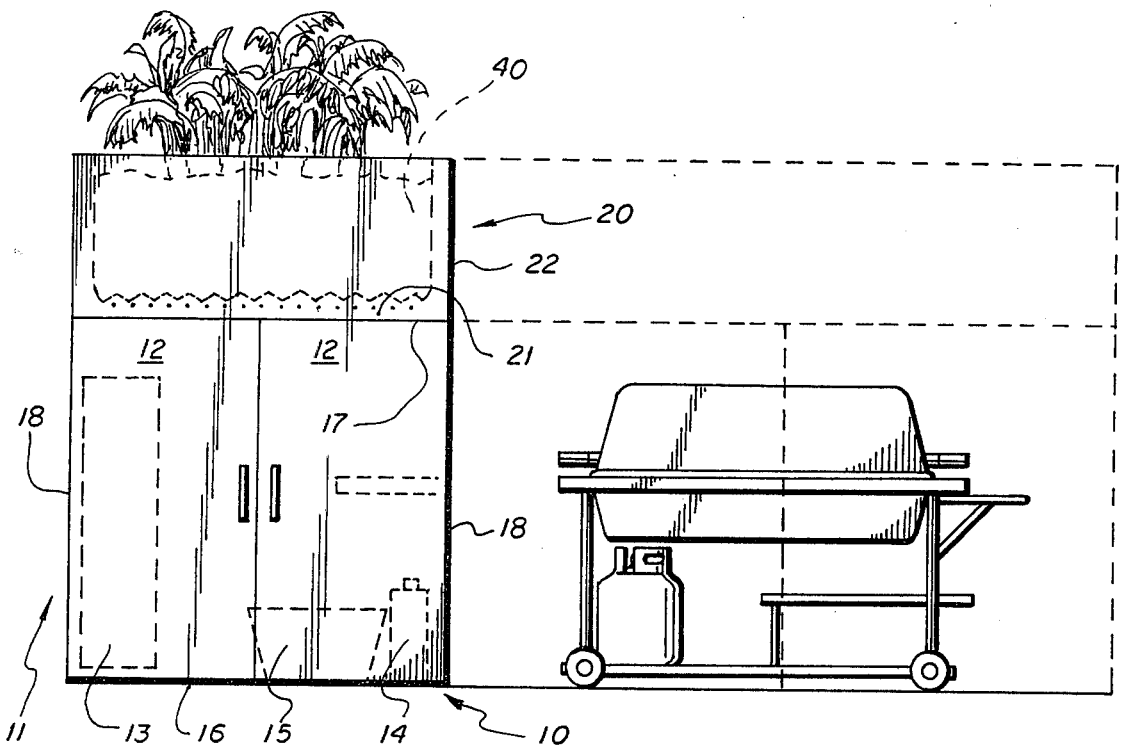
FIG. 1 is a front elevation of the basic module, with possible extensions thereof shown in phantom lines.
Figure 2:
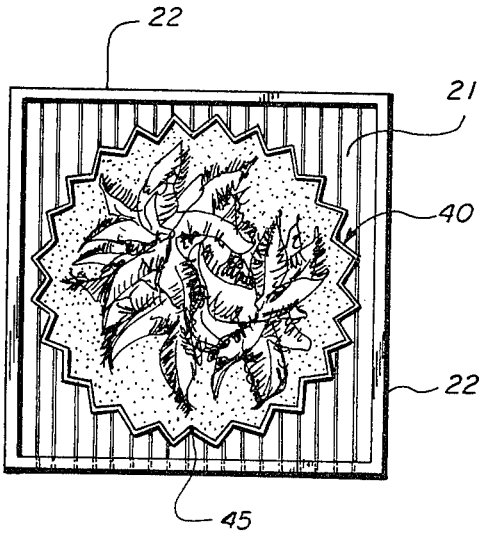
FIG. 2 is a plan view of the module portion of FIG. 1.

The basic modules 10 of FIGS. 1 and 2 include a base 11 and a removable planter portion 20. The base 11 would preferably include hinged doors 12 which, on being opened, reveal an internal cavity adapted to receive and store outdoor cookery equipment such as charcoal bulk storage container 13, starter fluid 14, and combustible charcoal holder 15. Such items would rest on floor 16, under roof 17 and between walls 18 of base 11.

Figure 1A:
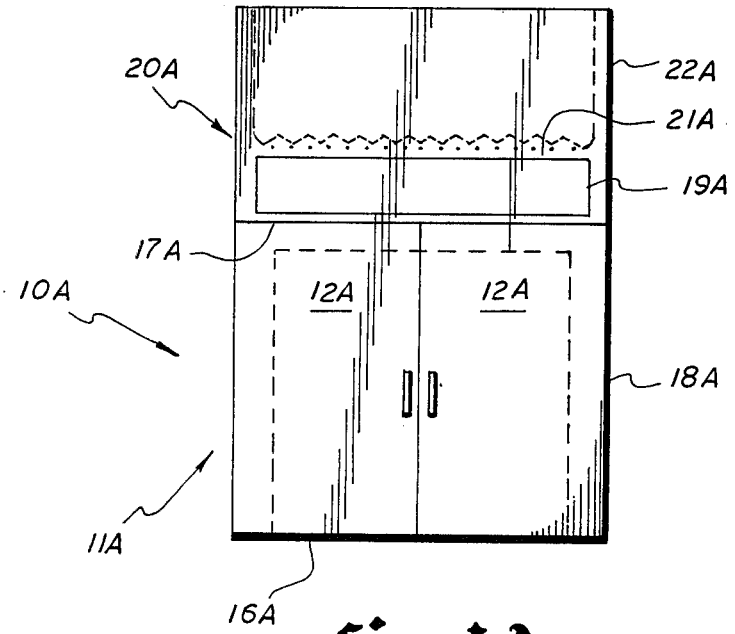
FIG. 1A is also a front elevation, but of a slightly modified basic module.

In FIG. 1A, suffix "A" has been added to the numbering scheme of FIG. 1, to identify similar parts. As an added feature, the modification of FIG. 1A includes an extended base portion, which hingedly accommodates trap door 19A. Obviously a sliding drawer could be substituted for the trap door Such a door, however, readily permits using the internal cavity as a dirty clothes hamper.

Figure 3:
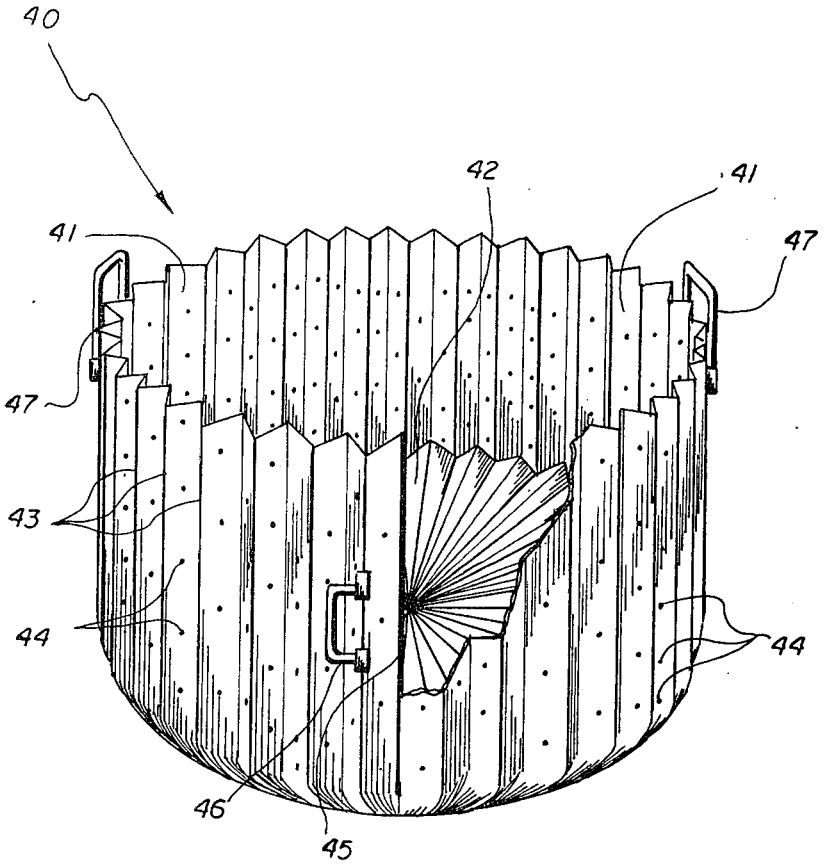
FIG. 3 is a perspective of the removable planter.

Moving now to the showing of particularly FIGS. 1, 2 and 3, the planter portion 20 is basically an open top cube, having a solid bottom 21, and sides 22. The planter is adapted to receive plant holder 40, particularly shown in FIG. 3. Such holder is generally cup like and may be annular (as shown) or rectangular in cross section, with bottom 42 and sides 41 which include ridges or cerrations 43. Intermediate such cerrations there may be a number of apertures 44. One side or wall 41 may be vertically scored, as at 45, and have handles or clips 46 on either side of such scorings, to permit one such side to be divided, permitting easy removal of any plant therein. Instead of scoring, the container side may be pre-divided, forming door-like portions without the need to break the web portions of such scoring. Clips, hooks, or other means of attachment 47 are provided the upper extremety of side walls 41, for purposes of attachment to side walls 22 of planter 20, and for displacing the plant holder.

Figure 4:
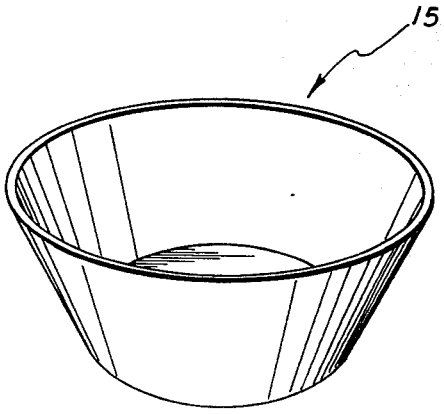
FIG. 4 is a perspective of the bricquet container.

The charcoal holder 15 of FIG. 4, includes a bottom and sides, with an open top. It is intended, however to be fabricated of a material that is slowly combustible.

As illustrated by the phantom lines of FIG. 1, the base portion of the module, as well as the planter, could be linearly extended, so as to accomodate further objects, such as a cooker, brazier or the like.

Practical advantages of the structure include the decorative ability to shift the planter portion 20, or of the plant holder 40 therein, from one module to another (assuming the owner to have 2 such modules or another satisfactory location), thereby varying the overall appearance of a room. Further, a great deal of clutter associated with outdoor cooking may be removed, or at least placed behind closed doors, so to speak. In such cooking, a relatively small number of bricquets may be placed in combustible container 15, forming a relatively concentrated source of intense heat, using fewer bricquets and requiring less starter fluid to start the fire. Finally, the unique plant container 40, when positioned within planter 20, would have a plant inside, including root system and dirt. The major portions of container 40 may well be fabricated of bio degradeable material. The cerrations 43 permit air circulation, apertures 44 permit drainage, and access means (scoring) 45 permit plant removal or treatment.

Figure 5:
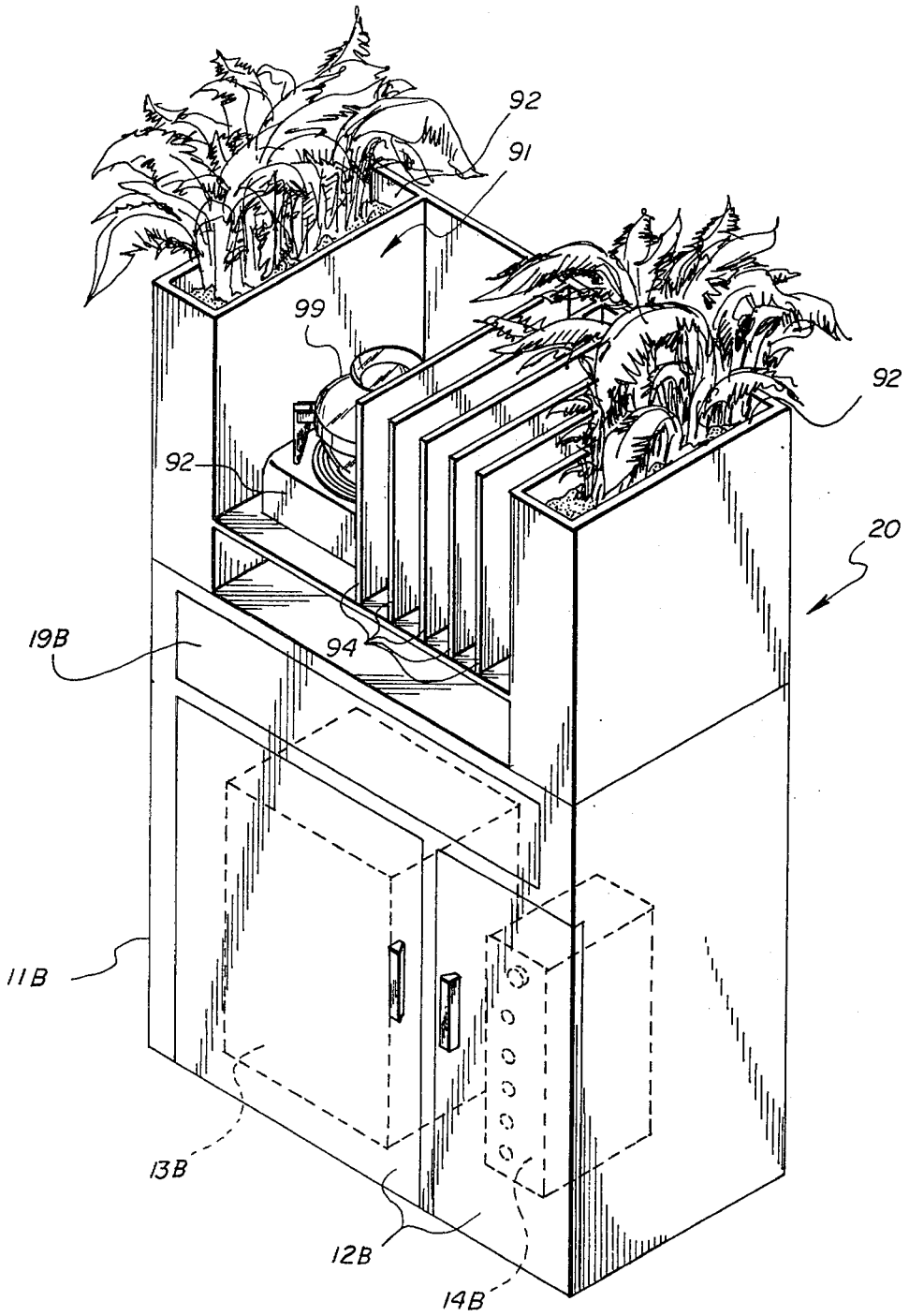
FIG. 5 is a perspective of a further embodiment.

In the embodiment of FIG. 5, removable container 20 includes a central dished portion 91, with oppositely positioned side plant accommodating portions 92. Said central dished portion may accommodate a burner 93, pot 99, and condiments within aligned holders 94. Base portion 11B, like that of FIG. 1A, may include a trap door 19B, access doors 12B, and inwardly thereof contain trash can 13B, and sound reproduction system 14B. This arrangement presents a different asthetic appearance, as well as another utilitarian plant arrangement.

Although limited embodiments have been described, it should be obvious that numerous modifications would be possible by one skilled in the art without departing from the spirit of the invention, the scope of which is limited only by the following claims.

We claim:

1. A modular article of furniture comprising of a base portion having side walls, a bottom, a top and an internal storage cavity and means for selectively permitting and barring access to said storage cavity; and a plant receiving portion, also having a bottom and sidewalls but open at the top, removably positioned atop said base, said plant receiving portion bottom being approximately concurrent with said base top and said plant receiving portion side walls representing lineal extensions of said base side walls when one is astride the other.

2. The article of claim 1 wherein said plant receiving portion includes a plant container removably positionable intermediate the plant receiving portions side walls and atop said plant receiving portion's bottom.

3. The article of claim 2 and including means for enhancing air circulation between said plant receiving portion and said plant container, said enhancing means including a plurality of ridges and valleys formed on the surface of said plant container.

* * * * *